US009739146B2

(12) United States Patent
Zhao

(10) Patent No.: US 9,739,146 B2
(45) Date of Patent: Aug. 22, 2017

(54) MINING METHOD

(71) Applicant: Xia Zhao, Xining (CN)

(72) Inventor: Xia Zhao, Xining (CN)

( * ) Notice: Subject to any disclaimer, the term of this patent is extended or adjusted under 35 U.S.C. 154(b) by 0 days.

(21) Appl. No.: 15/109,268

(22) PCT Filed: Jul. 22, 2015

(86) PCT No.: PCT/CN2015/084749
§ 371 (c)(1),
(2) Date: Jun. 30, 2016

(87) PCT Pub. No.: WO2016/045440
PCT Pub. Date: Mar. 31, 2016

(65) Prior Publication Data

US 2016/0326872 A1 Nov. 10, 2016

(30) Foreign Application Priority Data

Sep. 23, 2014 (CN) ..... 2014 1 0489128

(51) Int. Cl.
*E21C 41/32* (2006.01)
*E21C 41/26* (2006.01)
*E21C 41/16* (2006.01)
*E21C 41/28* (2006.01)

(52) U.S. Cl.
CPC ..... *E21C 41/32* (2013.01); *E21C 41/16* (2013.01); *E21C 41/26* (2013.01); *E21C 41/28* (2013.01)

(58) Field of Classification Search
CPC ..... E21C 41/32; E21C 41/26; E21F 15/08
USPC ..... 299/11, 18, 19
See application file for complete search history.

(56) References Cited

U.S. PATENT DOCUMENTS

| | | | | |
|---|---|---|---|---|
| 3,775,984 | A | 12/1973 | Livingston | |
| 4,007,965 | A * | 2/1977 | Shuttle, Jr. | E21C 41/00 299/11 |
| 4,150,853 | A | 4/1979 | McCoy | |
| 4,219,237 | A * | 8/1980 | Sisemore | E21B 33/13 299/11 |
| 4,453,770 | A | 6/1984 | Dalrymple et al. | |
| 4,589,700 | A * | 5/1986 | Schroder | E21C 41/26 299/18 |
| H1584 | H * | 8/1996 | Moore | E21C 41/32 588/250 |
| 5,782,539 | A | 7/1998 | Peterson | |

FOREIGN PATENT DOCUMENTS

| | | |
|---|---|---|
| CN | 102031972 | 4/2011 |
| CN | 102606160 | 7/2012 |
| CN | 102606161 | 7/2012 |
| CN | 102644464 | 8/2012 |

(Continued)

*Primary Examiner* — Sunil Singh
(74) *Attorney, Agent, or Firm* — Renner Kenner Greive Bobak Taylor & Weber

(57) ABSTRACT

The present invention provides a mining method. The method includes: dividing a mining region into a plurality of federated mining regions; performing an open-pit mining operation in each of the federated mining regions and forming a pit in each of the federated mining regions; performing an underground mining operation on a slope of the pit and forming a plurality of excavated tunnels; and backfilling a pit of a previous federated mining region with a spoil of a subsequent federated mining region.

14 Claims, 2 Drawing Sheets

(56) References Cited

FOREIGN PATENT DOCUMENTS

| | | | | |
|---|---|---|---|---|
| CN | 103790589 | | | 5/2014 |
| CN | 104389606 | | | 3/2015 |
| RU | 2213224 | C1 | | 9/2003 |
| RU | 2442896 | C1 | * | 2/2012 |
| RU | 2521987 | C1 | | 7/2013 |
| SU | 1681001 | A1 | * | 9/1991 |

* cited by examiner

MINING METHOD

TECHNICAL FIELD

The present application relates to a mining method.

BACKGROUND

In the mining technology, compared to the underground mining method, the generally adopted open-pit mining method at present has the advantages of full resource utilization, low cost, high recovery rate, fast construction of mines, high output, a better working condition, and a safer working environment. However, the open-pit mining method has the disadvantages of being severely limited by natural occurrence conditions. In addition, during the course of mining, large area of fertile farmlands are occupied, and noticeable anthropogenic changes occur to the ecological environment of the mining region, which are manifested in destructions to the landform, heavy metal pollution, and aggravated water loss and soil erosion. Furthermore, due to the fact that open-pit mines are mostly located at the ecologically fragile arid/semi-arid regions, the functional life support system of the open-pit mining region is lost, in particular, the vegetation system is damaged, thereby further increasing the vulnerability of the ecological environments and the degeneration rate, as well as threatening severely the ecological safety of the mining region.

Although the underground mining method is more environment-friendly, the increased mining difficulty and the more hostile environment of the underground mining method compared with the open-pit mining method raises a higher requirement for the mining equipment, the operator qualification, and the mining process. For example, in some mining regions, permanent frozen earth with thickness of 50 to 98 m and comprising quaternary humus soils, sandy soils, partial bed rocks and the like is widely spread and, which likely results in the problem of deteriorated engineering geology, a building cycle of at least 5 years within such mining regions and high investment cost. Therefore, it is hard for enterprises to sustain. Moreover, a main shaft, an auxiliary shaft, and a ventilating shaft are typically required to be dug in the conventional underground mining process, resulting in crisscrossed underground tunnels. As a result, the damaged underground after mining cannot be recovered and the secondary disaster brought by the subsidence of the mined region cannot be avoided. In particular, the grassland landform damaged by the gangue field cannot be restored and the stacked wastes have to be left permanently in the mining region, which is adverse to the recovery of the ecological environment. Additionally, some other secondary disasters, such as gas and coal dust, roof collapse, wall caving, water leakage and the like, may also be induced by the underground mining method.

Therefore, developing an environment-friendly coal mining method that enables cost saving, simple operations and safe production is a challenging problem to be solved.

SUMMARY

With respect to the problems of landform destruction and environment pollution caused by the prior art coal mining method, the present application provides a safe and efficient mining method.

To this end, the mining method provided by the present application may comprise: dividing a mining region into a plurality of federated mining regions; performing an open-pit mining operation in each of the federated mining regions and forming a pit in each of the federated mining regions; performing an underground mining operation on a slope of the pit and forming a plurality of excavated tunnels; and backfilling a pit of a previous federated mining region with a spoil of a subsequent federated mining region.

In an embodiment of the present application, a spoil of a first federated mining region may be filled into a last federated mining region after completing a mining work in the last federated mining region.

In an embodiment of the present application, the slope of the pit may be formed into a stepped platform.

In an embodiment of the present application, the plurality of excavated tunnels are sequentially or randomly formed.

In an embodiment of the present application, the above-mentioned method may further comprise: processing the spoil into a paste; and filling the plurality of excavated tunnels with the paste through a filling pump and/or by gravity.

In an embodiment of the present application, a safety angle of the slope of the pit may be equal or less than about 40°.

In an embodiment of the present application, the underground mining operation may be performed in an end-slope mining manner.

In an embodiment of the present application, the performing the underground mining operation may comprise: performing a horizontal mining operation or a vertical mining operation according to a mine distribution structure of the federated mining region.

In an embodiment of the present application, the above-mentioned method may further comprise: performing a surface vegetation operation after the backfilling of the federated mining region is completed.

According to the above-mentioned method, when a subsequent federated mining region is being mined, the previously mined federated mining region may be filled with the discarded rock-soil and waste-residues generated in this federated mining region. For example, when a second federated mining region is being mined, a first federated mining region may be filled with the discarded rock-soils and waste-residues generated in the second federated mining region, and so on. As such, the original landform of the previous federated mining region may be recovered in time during the mining process. Besides, vegetation, such as trees, may be planted in the filled federated mining region when the mining work is being performed in other regions, which further afforests the federated mining region and protects the environment.

BRIEF DESCRIPTION OF THE DRAWINGS

The drawings are provided for a further understanding of the solution proposed by the present application and constitute a part of the specification. The drawings serve to explain the present application together with the specific embodiments of the present application, but not to limit the present application. In the drawings.

Figure 1:
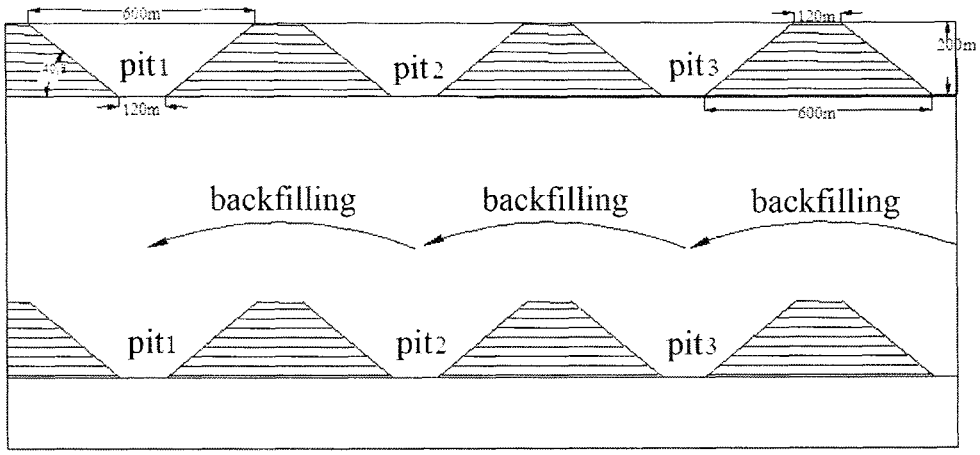
FIG. 1 is a sectional view of an exemplary mining region where a mining method according to an embodiment of the present application may be implemented.

| Reference numerals |
|---|
| 1. Open-pit mining region |
| 2. Mining region of end-slope coal mining machines |
| 3. End-slope coal mining machine |
| 4. Pasty grout |
| 5. Vegetation |
| 6. Surface soil layer |
| 7. Filling station |
| 8. Filler |
| 9. Filling pipe |
| 10. Blocking wall |
| 11. Underground mining sequence number |

DETAILED DESCRIPTION

The particular embodiments of the present invention will be described in details hereinafter with reference to the accompanying drawings. It should be appreciated that the particular embodiments described herein serve to only illustrate and explain the present invention, but not to limit the present application.

As shown in FIG. 1, first, a mining region of an open-pit mine is divided into several smaller mining units, i.e., a plurality of federated mining regions. Each of the federated mining regions undergoes open-pit mining by utilizing excavators and mine trucks and a pit is formed therein. For example, the upper opening of the open pit may be formed with a size of 600 m×600 m, an area of 0.36 $km^2$, a drawdown of 200 m, a safety angle of a slope of 40° or less, and a lower width of a foundation pit of 120 m, for a mining region that has a coal seam inclined to the middle to form a V-shape in the north-south direction and has a coal strip with a width of 1 km in the north-south direction and a length of 5 km in the west-east direction.

Figure 2:
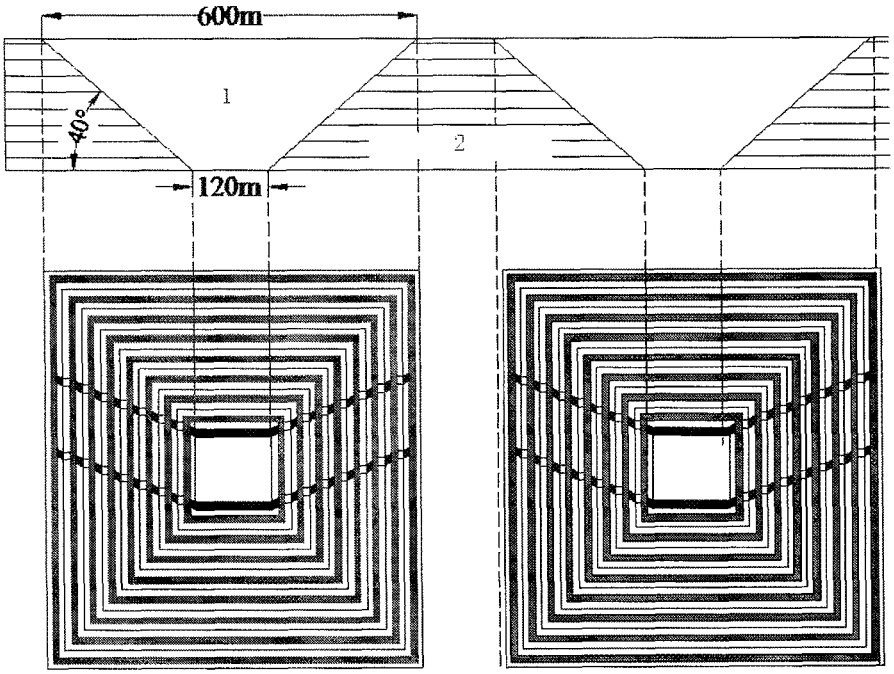
FIG. 2 is a top view of an exemplary mining region where a mining method according to an embodiment of the present application may be implemented.

Next, an underground mining operation is performed on the slope of the pit and a plurality of excavated tunnels are formed. According to an embodiment of the present application, the slope of the pit may be formed as a stepped platform. As shown in FIG. 2, a safety platform with a particular size is built every certain decrease in altitude. For example, a safety platform with a width of 10-20 m is built every decrease of 10 m in altitude. The safety platform may be used for building a transport channel while preserving a working location for, e.g., an end-slope underground mining operation. The end-slope equipment may be disposed, for example, at the front of a seam to be mined. The underground mining of surrounding seams within the pit is performed with underground mining equipment. The particular operating scheme of the underground mining depends on a seam area, a seam extension direction and a seam inclination angle. For example, the underground mining may be horizontally or vertically performed, and it is possible only to mine for coal but not to peel rocks during mining courses. It should be noted that, each end-slope tunnel is disposed to be mined nearly horizontally for both a steeply inclined coal seam and a nearly horizontal coal seam. The only difference lies in the mining location for a subsequent tunnel relative to that of the previously excavated tunnel, i.e., it may be a horizontal arrangement or a vertical arrangement. The horizontal arrangement or the vertical arrangement mentioned herein refers to the location layout of the end-slope underground mining operations. However, the mining within each tunnel is definitely performed in a nearly horizontal direction. Generally, only coal is extracted while rocks are unpeeled during an end-slope mining process.

Typically, an open-pit mining process is performed prior to an end-slope underground mining process for each federated mining region. However, according to actual mining conditions, the end-slope underground mining process may be performed after the open-pit mining process is completed, and the end-slope underground mining process may be performed concurrently with the open-pit mining process when the open-pit mining process is performed down to a certain depth, i.e. "multi-pit federated mining".

Figure 3:
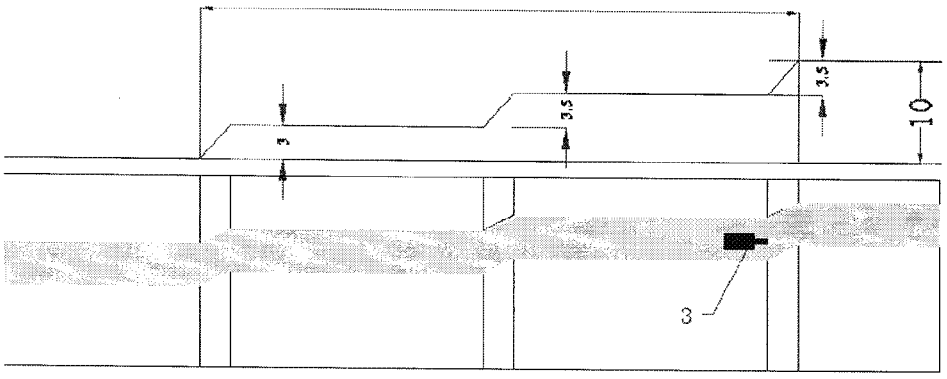
FIG. 3 is a schematic diagram illustrating a mining process using an end-slope coal mining machine.

FIG. 3 is a schematic diagram illustrating a mining process using an end-slope coal mining machine. As shown in FIG. 3, an end-slope coal mining system is utilized on a certain working platform to perform mining operations to predetermined depths for the upper surface and the lower surface of the coal seam area, respectively (e.g., 120 m for the upper mining surface, and 600 m for the lower mining surface).

After the mining in the first federated mining region is completed, an open pit and tunnels are built in a second federated mining region and similar mining operations are performed therein.

Next, the pit of the first federated mining region is filled with spoil, e.g., rock-soil, waste-residues and the like, generated through the mining work performed in the second federated mining region in order to recover the original landform in time during the mining process.

Then, a third federated mining region undergoes mining in a similar way as mentioned above. The mined region of the second federated mining region is filled with the spoil generated through the mining operation performed in the third federated mining region. And so on, until all of the coal mining operations are completed. After the mining operation performed in the last federated mining region is completed, the last federated mining region is filled with the spoil of the first federated mining region in order to completely recover the original surface appearance. The spoil of the first federated mining region may be stacked at a temporary waste dump to be used as backfill for the last federated mining region. Vegetation, such as trees, may be planted after the pit is filled in order for further afforestation and protection of environment.

Figure 4:
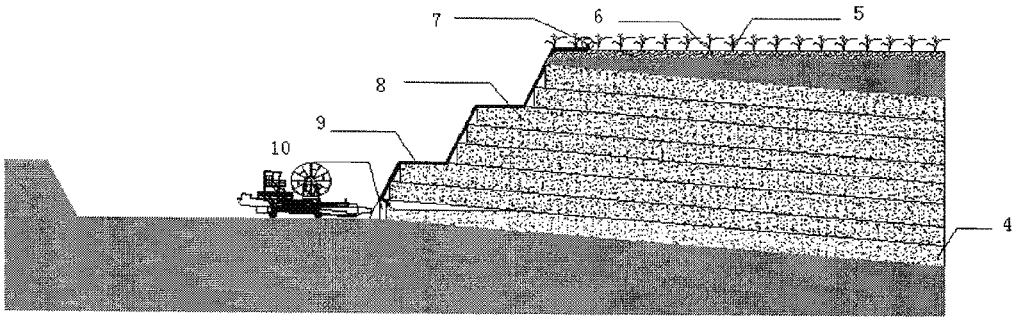
FIG. 4 is a schematic diagram illustrating a filling paste processing method according to an embodiment of the present application.

According to an embodiment of the present application, the spoil may be further processed into paste, which is used to fill excavated tunnels through a filling pump and/or by gravity. Solid wastes, such as coal gangues, rock-soils and the like, may be, for example, processed into pasty grout on the ground, and then, as shown in FIG. 4, the paste is used to fill excavated tunnels of the pit through the filling pump and/or by gravity. In an embodiment, the paste is transferred to the underground via a pipe and fills the mined region in time so that an overlaying rock stratum is supported and the movement of the overlaying rock stratum is limited by the paste filling, thus ensuring a safe surrounding rock environment for coal mining tunnels all the time and increasing the mining rate of coal resources. Meanwhile, surface subsidence and secondary geological disasters that are likely to result, which other mining processes cannot avoid, are prevented. It should be noted that, the paste filling is generally applied to a thick coal seam or an inclined coal seam (deemed as an ultra-thick coal seam), while a thin horizontal coal seam may not need to be filled as long as there are temporary coal pillars and permanent coal pillars for rectangularly arranged end-slope underground mining.

Figure 5:
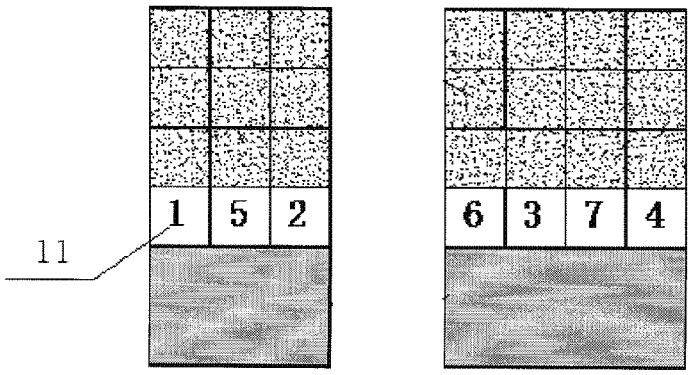
FIG. 5 schematically illustrates a skip mining and filling sequence within a built pit according to an embodiment of the present application.

A plurality of excavated tunnels may or may not be formed in sequence in order to ensure enough solidification time for the filler before the filler begins to function. For example, the underground mining may be performed in accordance with the skip mining sequence as shown in FIG. 5.

The mining method provided by the present application employs schemes of cyclical mine constructing, simultaneous mining, and alternate backfilling. Besides, the coal mining and paste filling techniques are suitably combined with the excavating technique. Accordingly, a higher rate of mine recovery is achieved while the backfilling is completed, the mining region is afforested and the ecological environment of the mining region is protected. Furthermore, the mining method provided by the present application reduces both the transport distance and the excavated volume and thus reduces the production cost of a mining enterprise.

Therefore, the recovery multi-pit federated mining method provides an effective technical solution to resolve the conflict between resource exploit and environment protection and provides an example for the country to construct environment-friendly mining regions. This is of strategic importance to the promotion of resource exploit in ecologically fragile areas of the nation, as well as the development of environment protection techniques.

Although the preferred embodiments of the present invention have been described above in details with reference to the drawings, the present application is not limited to the particular details of the above embodiments. A variety of simple variations may be made to the technical solutions of the present invention within the technical concept of the present application, and all of these simple variations fall into the scope of the present invention.

What is claimed is:

1. A mining method, comprising:

dividing a mining region into a plurality of federated mining regions;

performing an open-pit mining operation in each of the federated mining regions and forming a pit having a slope in each of the federated mining regions, wherein the slope is formed into a stepped platform having a plurality of multistage platforms;

performing an underground mining operation on the plurality of multistage platforms of the slope of the pit and forming a plurality of excavated tunnels; and backfilling a pit of a previous federated mining region with a spoil of a subsequent federated mining region; the backfilling comprising:

processing the spoil into a paste; and filling the plurality of excavated tunnels with the paste.

2. The mining method of claim 1, further comprising:

backfilling, after completing mining work in a last federated mining region, the last federated mining region with a spoil of a first federated mining region.

3. The mining method of claim 2, further comprising:

performing a surface vegetation operation after backfilling the federated mining region is completed.

4. The mining method of claim 1, wherein the paste is filled through a filling pump and/or by gravity.

5. The mining method of claim 4, further comprising:

performing a surface vegetation operation after backfilling the federated mining region is completed.

6. The mining method of claim 1, wherein the plurality of excavated tunnels are sequentially or randomly formed.

7. The mining method of claim 6, further comprising:

performing a surface vegetation operation after backfilling the federated mining region is completed.

8. The mining method of claim 1, wherein a safety angle of the slope of the pit is equal to or less than approximately 40°.

9. The mining method of claim 8, further comprising:

performing a surface vegetation operation after backfilling the federated mining region is completed.

10. The mining method of claim 1, wherein the underground mining operation is performed in an end-slope mining manner.

11. The mining method of claim 10, further comprising:

performing a surface vegetation operation after backfilling the federated mining region is completed.

12. The mining method of claim 1, wherein the forming a plurality of excavated tunnels comprises: performing a horizontal mining operation or a vertical mining operation.

13. The mining method of claim 12, further comprising:

performing a surface vegetation operation after backfilling the federated mining region is completed.

14. The mining method of claim 1, further comprising:

performing a surface vegetation operation after backfilling the federated mining region is completed.

* * * * *